US005098312A

United States Patent [19]

Raczynski

[11] Patent Number: 5,098,312

[45] Date of Patent: Mar. 24, 1992

[54] EQUIPMENT CONNECTOR

[76] Inventor: Walter Raczynski, 1601 Lexington, Arlington Heights, Ill. 60004

[21] Appl. No.: 728,262

[22] Filed: Jul. 11, 1991

[51] Int. Cl.[5] ..... H01R 13/627

[52] U.S. Cl. ..... 439/362; 439/296

[58] Field of Search ..... 439/296, 299, 359, 361, 439/362, 364, 365, 368, 936

[56] References Cited

U.S. PATENT DOCUMENTS

| | | | |
|---|---|---|---|
| 3,056,942 | 10/1962 | Carbaugh et al. | 439/362 |
| 3,582,867 | 6/1971 | Thompson | 439/362 |
| 4,456,319 | 6/1984 | Ricoos | 439/359 |
| 4,929,184 | 5/1990 | Emadi et al. | 439/362 |

*Primary Examiner*—Larry I. Schwartz
*Assistant Examiner*—Hien D. Vu
*Attorney, Agent, or Firm*—Lockwood, Alex, FitzGibbon & Cummings

[57] ABSTRACT

An apparatus by which a connection between a plug and a socket of computer-related equipment can be secured by the reception of male elements in openings associated with the socket. The apparatus includes a continuous belt, wrapped around a housing in which the plug is fixed. By the manipulation the belt, the male elements can be rotated in synchronized fashion. Advantageously, the belt is structured and may be made of a material that prevents overtorquing and, thereby, damage to the connector during rotation of the male elements.

20 Claims, 3 Drawing Sheets

EQUIPMENT CONNECTOR

BACKGROUND AND DESCRIPTION OF THE INVENTION

The present invention relates to an apparatus for connecting equipment. More particularly, the invention relates to an apparatus by which computer-related equipment, such as peripherals, may be attached to and detached from, for example, other peripherals or a central processing unit quickly and without the need for tools. Uniquely, the invention facilitates the connection between such equipment by the external manipulation of the housing of the apparatus.

Computer-related equipment, such as peripherals and central processing units, are generally linked to each other through signal cables. Attachment of the signal cables to the computer equipment is accomplished through a variety of devices, commonly termed interfaces. One type of interface includes leads or pins to which one or more of the many wires incorporated within the signal cable are attached. The ends of the pins are sized and shaped so that they may be snugly received in similarly sized and shaped receptacles aligned in a socket that is generally fixed in a wall of the computer equipment. The simple reception of the pins within the receptacles, however, does not secure the connection of the plug to the socket. The connection can be easily disrupted, such as by pumping the plug or by pulling on the cable.

Many means are known to secure the connection between the plug and the socket. One such securing means includes male elements—such as threaded bolts—carried in a housing in which the plug is fixed. The male elements are appropriately sized and shaped to be received within female elements—threaded in those embodiments in which the male element is threaded—associated with the socket. With such means, in order to secure the plug to the socket, and, thereby, the pins within the receptacles, the plug is positioned adjacent to the socket and such that male elements in the plug can be received—such as by threading—into the female elements in the socket.

Many means are known by which the threading of the male plug element into the female socket element is accomplished. In some housings, the male elements have heads opposite to the threaded ends. In these housings, the male elements are carried such that the heads project outward from a rear wall of the housing. The heads may have a surface configuration such that a user must use a tool, for example, a screwdriver or an allen wrench, to turn each of the male elements separately. In other housings, male elements are carried that have heads sized and shaped and that project from the housing such that a user must rotate each of the male elements by turning it by its head in order to connect the male element into the female elements.

Rotating the male element with the use of a tool or by hand is difficult generally because of the awkward position the male elements project from the housing. Typically, the male elements project from the back side of the housing—that is opposite to the side from which the plug pins are exposed—and to either side of the signal cable. It is difficult for a user to rotate the male elements by hand or with a tool given such a awkward position of the male elements.

In those housing embodiments in which a tool is needed to turn the male element, the tool is generally of a size that is proportional to the small size of the head. Such a small size tool can be difficult to manipulate, particularly for those users having larger fingers. Also, a small size tool can be easily lost.

Improper seating of the plug as it is being attached to the socket is a problem common to many known housing embodiments. In order to prevent the misseating of the plug within the socket, a user generally must cautiously rotate each male element alternately and only a limited amount each time. The amount that each male element can be rotated before the plug becomes misseated is empirically determined. This is a time consuming and not altogether fool proof task. Also, because each male element must be rotated alternately, the quick attachment of the plug to the socket is prevented.

In conventional housing designs, it is not always apparent when the male element is fully threaded into the female element and the user has actually begun to overtighten the male element. Overtorquing is a common problem. Particularly with a housing having a thin wall construction overtorquing can cause a failure of the housing material—such as cracking—around the male element. Overtorquing may also cause the shaft of the male element to fail.

In disconnecting known plugs from sockets, the amount that the male element can be backed out before it is completely separated from the housing is empirically determined also. This sometimes causes the male element to be inadvertently separated from the connector housing. Because of the generally small size of the male elements, male elements inadvertently separated from the housing can be easily misplaced or lost.

Other known connectors—while they operate such that the likelihood of damage to the plug housing or socket is minimized—are complicated structures whose cost to manufacture are, accordingly, greater. Connectors having a complicated, multi-component structure also tend to be less reliable than connectors having a simplified structure.

A demand therefore exists for a connector having a simplified structure by which a plug contained within a housing may be quickly connected to a socket without the need for tools and without damage to the housing, plug, or socket. The present invention satisfies the demand.

The present invention provides a connector by which electrical and mechanical connection between a plug and socket may be effected quickly and without the need for a tool. More specifically, the connector includes a housing in which the plug is fixed and having an outer surface that can manipulated by a user with one hand to rotate a plurality of threaded male elements carried within the housing in synchronized fashion so that uniform connection between the male elements and female elements associated with the socket can be effected. The means by which the manipulative force applied by the user is transmitted to rotate the male elements in synchronized fashion is of a simplified structure and prevents overtorquing of the male elements within the housing. The material from which the synchronized power transmission means is made may also be chosen to further facilitate the smooth transfer of power to the male elements and to further prevent any likelihood that damage will be caused to the housing from overtorquing. The housing may include also means by which the male elements may be retracted in those instances in which the socket does not include appropriately sized and shaped female elements to receive the male elements.

An object of the present invention is to provide a connector by which computer-related equipment may be quickly connected.

Another object of the present invention is to provide a connector for connecting a plug to a socket by rotating a plurality of male elements rotatably carried in a housing into appropriately sized and shaped female elements.

An additional object of the present invention is to provide a connector having means generally adjacent to whose outer surface that can be manipulated by a user which one hand to effect a connection.

Also, an object of the present invention is to provide a connector having a power transmission means such that a plurality of male elements within a housing can be turned in synchronized fashion.

An added object of the present invention is to provide a connector made from a material and of a structure such that a plurality of male elements can be secured to female elements without causing damage to the connector housing.

These together with other objects and advantages will become subsequently apparent from a reading of and reside in the details of construction and operation as more fully hereinafter described and claimed, reference being had to the accompanying drawings forming a part hereof, wherein like numerals refer to like parts throughout.

DESCRIPTION OF THE PARTICULAR EMBODIMENTS

Figure 1:
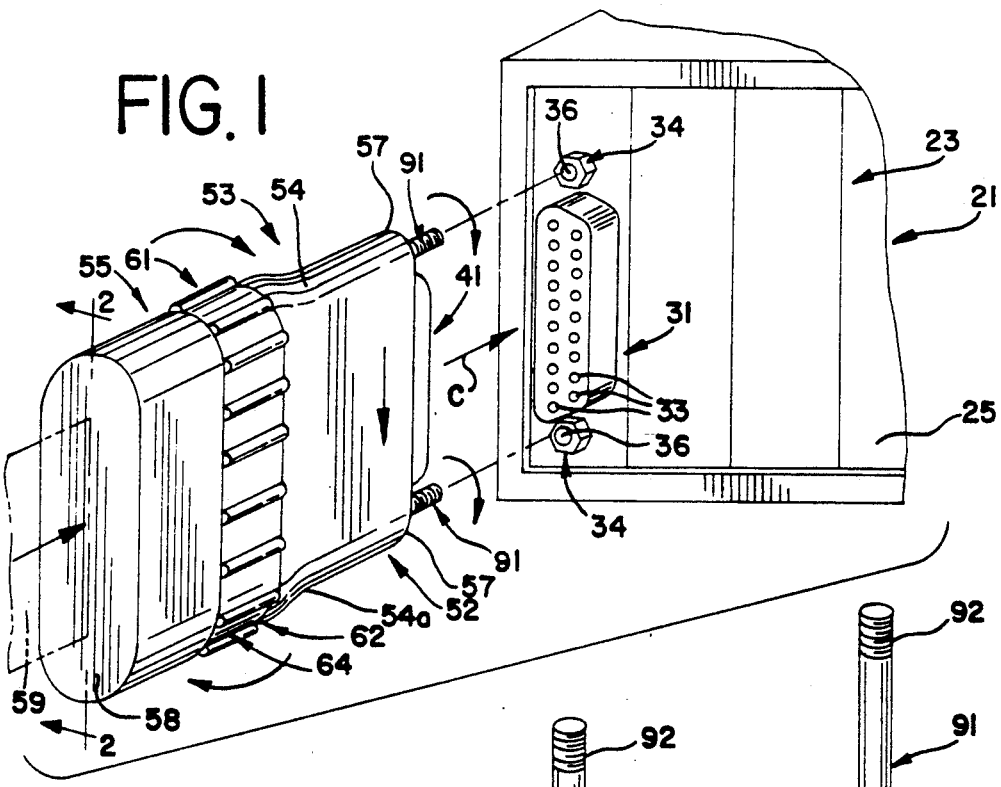
FIG. 1 is a pictorial view of an equipment connector according to the present invention by which an interface plug contained within the housing can be connected to an interface socket.
Figure 4:
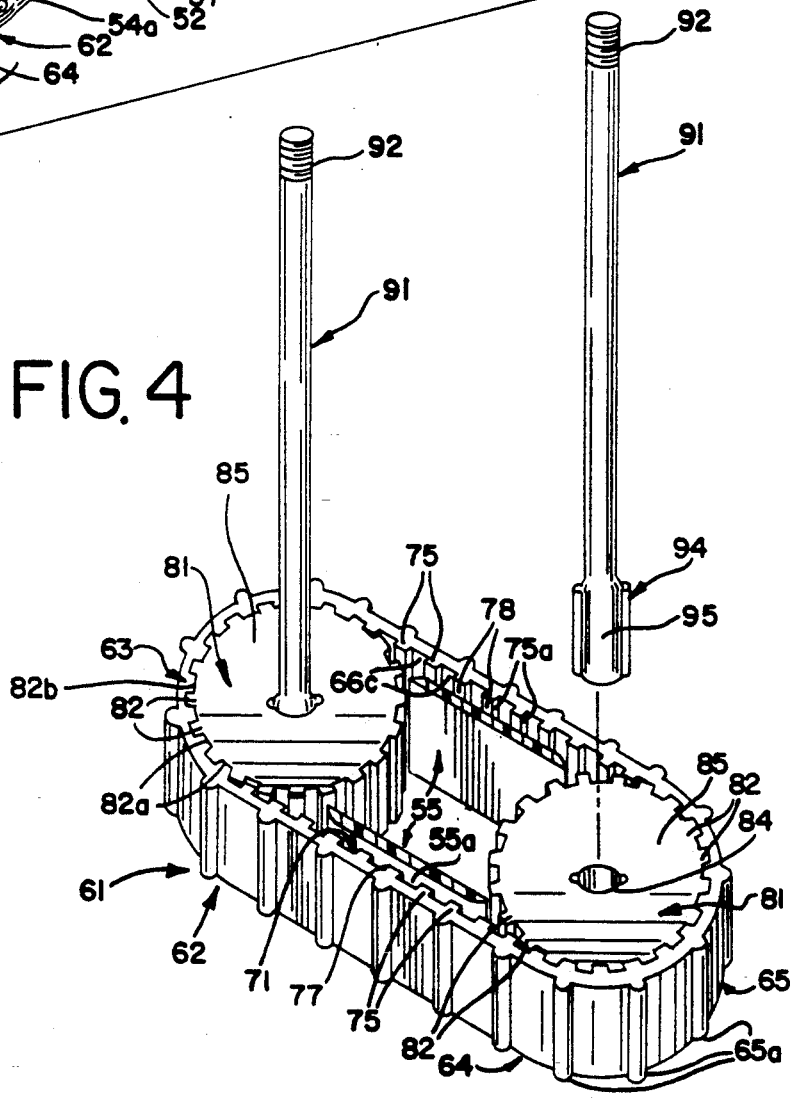
FIG. 4 is a partially exploded pictorial view showing the synchronized power transmission means by which the male threaded elements are engaged.

A known piece of computer-related equipment, such as a central processing unit, is illustrated in FIG. 1 and generally designated by reference numeral 21. Equipment 21 typically includes a cabinet 23 formed from walls including a rear wall 25.

Figure 2:
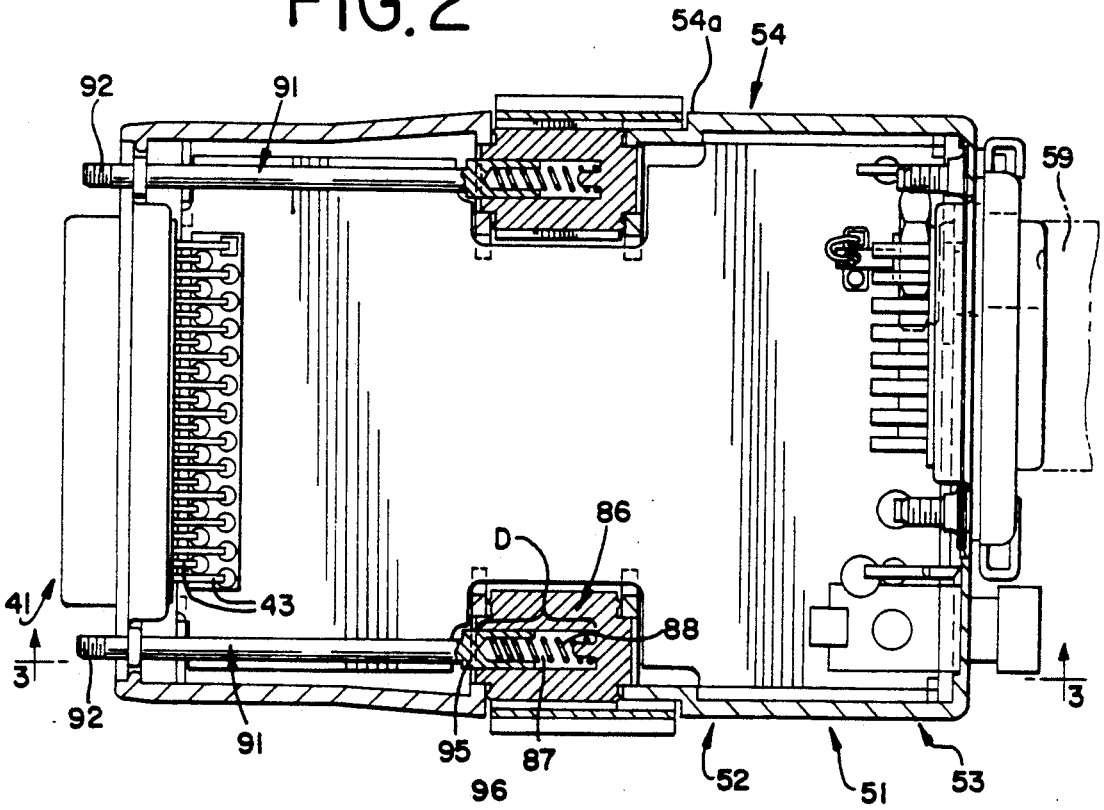
FIG. 2 is a cross-sectional view of the embodiment taken along the plane 2—2 as shown in FIG. 1.

Typically, a socket 31, having receptacles 33 sized and shaped to matingly receive pins 43 (whose connecting ends are illustrated in FIG. 2) of a plug 41, opens from the rear wall 25.

The mating reception of the pins 43 in the receptacles 33 is generally maintained by the reception of a plurality of male elements 91 rotatably carried in the housing 52 of the plug 41 in appropriately numbered and positioned lugs 34 associated with the socket 31. Male elements 91 can include acme or lead (long helix) screws. In the embodiment of the computer-related equipment 21 shown in FIG. 1, the socket 31 is flanked by two symmetrically positioned lugs 34 that contain openings 36 in which male elements 91 can be received. Lug openings 36 have female threaded inner walls (not shown) in those embodiments in which male elements 91 that are threaded are to be received therein.

Figure 3:
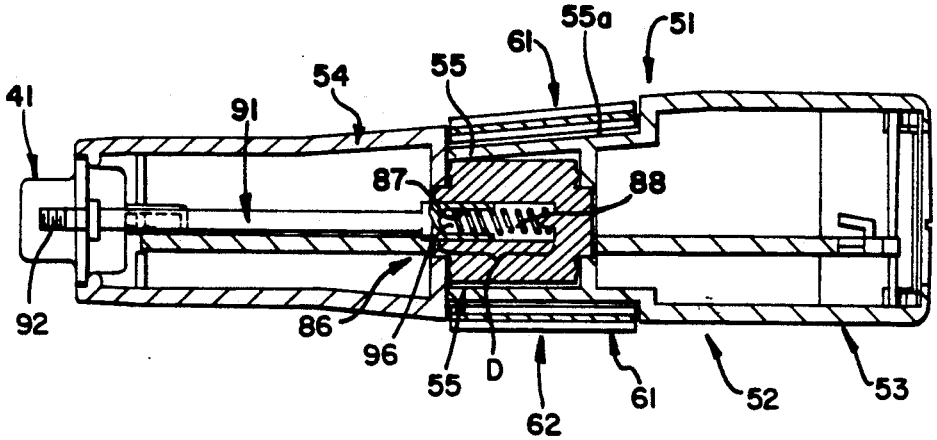
FIG. 3 is a cross-sectional view of the embodiment taken along the line 3—3 as shown in FIG. 2.
Figure 5:
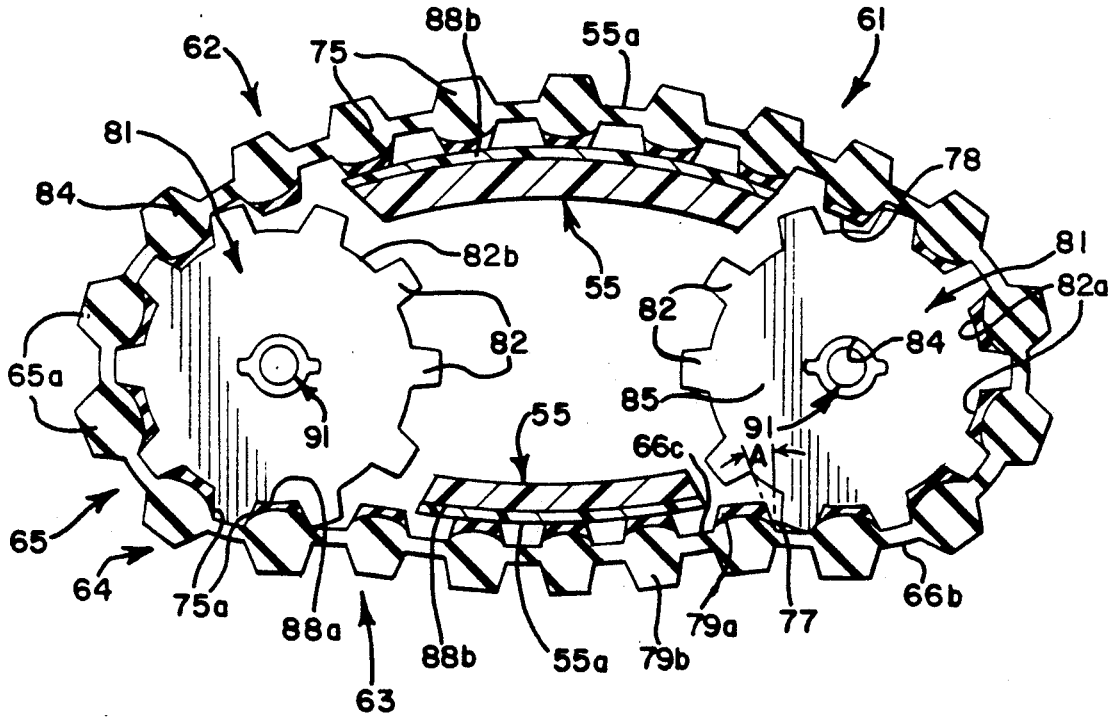
FIG. 5 is a cross-sectional overhead view of another embodiment of the synchronized power transmission means.

An equipment connector according to the present invention is generally illustrated by reference numeral 51 in FIGS. 1 through 3. Equipment connector 51 includes a housing 52 for the plug 41, synchronized power transmission means 61, and a plurality of male elements 91. Housing 52 includes a case 53—generally formed from a surrounding wall 54, a front side wall 57, and a rear side wall 58—preferably made from generally non-compliant, electrically non-conducting material such as a thermoplastic, for example, a polycarbonate or ABS, suitably spray-coated with conductive shielding material for purposes of controlling EMI/RFI emissions. Signal cable 59 (one type of which—a ribbon cable—is shown in phantom in FIGS. 1 and 2) enters the case 53 such as generally through the rear side wall 58.

Male connecting elements 91 rotatably carried within the housing 52 facilitate mechanical connection between the plug 41 and the socket 31 and electrical connection between the plug pins 43 and receptacles 33. The embodiments of the connector 51 illustrated in FIGS. 1 through 5 includes two male connecting elements 91 axially aligned parallel to the longitudinal axis "C" of the connector 51. Each male element 91 includes a forward end 92 sized and shaped and, where appropriate, threaded, to be securable within lug openings 36.

Synchronized power transmission means 61 are those means which a user can manipulate to transmit force to the male elements 91 so that they turn in synchronized fashion while avoiding overtorquing. In the embodiments of the housing 52 illustrated in FIGS. 1 through 5, the synchronized power transmission means 61 includes a belt 62 and pulleys 81. These elements will individually described.

In the illustrated embodiment, belt 62 includes a continuous element 63 wrapped around the connector 51 such that outer surface 64 of belt 62 is adjacent to the surface 54*a* of the surrounding wall 54 of case 55. Belt 62 is preferably sized and shaped such that a user can rotate the belt 62 simply with one hand by applying a pushing/pulling force to the belt 62. Outer surface 64 of belt 62 may include texture 65 to facilitate manipulation by a user. In the FIGS. 1 through 5 embodiments, texture 65 includes ribs 65*a* axially aligned generally parallel to the longitudinal axis "C" of the male connecting elements 91 and housing 52 and generally perpendicular to the direction in which the belt 62 is rotated. Texture 65 of the outer surface 64 of belt 62 may include toothed or knurled shapes and pebbled surfaces.

Pulleys 81 receive and transmit the manipulative force applied to the outer surface 64 of the belt 62 to the male elements 91 so that the elements 91 turn in synchronized fashion. Pulleys 81 include teeth 82 sized and shaped to receive inner ribs 75 spaced along the inner surface 71 of belt 62. When the belt 62 is rotated, inner ribs 75 slot into the inter-teeth grooves 82*a* thereby transmitting the power to the pulleys 81. The rate at which the pulleys 81 are rotated for each rotation of belt 62 may be varied by varying the number of inner ribs 75 and the number of grooves 82*a*.

To allow force to be applied to the belt 62 in the area of the connector 51 between the pulleys 81, the surrounding wall 54 preferably includes a raceway 55 having a surface 55*a* adjacent to the inner ribs 75 of the belt 62 so that the head surface 78 of each inner rib 75 contacts the raceway surface 55*a* as manipulative force is applied to the outer surface 64 of the belt 62. To allow the ribs 75 to pass smoothly past the surface 55*a*, raceway 55 may be configured such that the surface 55*a* is curved and so that the outer surface 64 of belt assumes a general convex shape.

While each male element 91 can be mated with a pulley 81 such that, for example, the element 91 is of integral construction with a pulley 81, each pulley 81 may include an aperture 84 to matingly receive a rearward end 94 of male element 91. In the embodiment of the connector 51 shown in FIG. 4, the rearward end 94 of each male element 91 includes a spline-shaped base 95 that is receivable through an appropriately shaped aperture 84 in the surface 85 of the pulley 81.

Advantageously, so that one or more of the male elements 91 may be retracted when connection is attempted with a socket 31 not having female elements, each synchronization pulley 81 may include retraction means 86. In the embodiment of the connector 51 illustrated in FIGS. 2 and 3, the pulleys 81 include pulley openings 87 having a depth "D" to accommodate a greater portion of the rearward end 94 upon pushing the male element 91, such as from its forward end 92. So that the male element 91 can automatically return to a position to be engaged within an opening 36, a spring 88 may be mounted within pulley opening 87 and contacting the male element 91, such as through the spring reception area 96 illustrated in FIGS. 2 and 3 that opens within rearward end 94 of the male element 91. In the FIGS. 2 and 3 embodiment, the spring 88 is mounted within opening 87 and engages the rearward end 94 of the male element 91 such that the spring 88 generally biases the male element 91 forward.

To prevent a user from rotating the male element 91 to that degree that, for example, the pulley 81 fails, such as by cracking, the inner ribs 75 may include side walls 75*a* that are sloped. In the embodiment of the belt 62 shown in FIG. 5, each side wall 75*a* forms an angle "A" of approximately thirty degrees to a line perpendicular to the inter-rib surface 77. With such an embodiment, once the end 92 of male element 91 is fully received within the opening 36, any additional manipulative force applied to the outer surface 64 of belt 62 will cause the inner ribs 75 to slip out of engagement with the teeth 82. A belt 62 having side walls 75*a* sloped at an angle "A" of approximately thirty degrees is preferred as such ribs 75 do not bind during manipulation of the belt 62 as do ribs 75 having side walls 75*a* sloping at small angles to a perpendicular.

The materials from which the belt 62 is made can be chosen to further facilitate manipulation of the belt 62 and also to further prevent overtorquing. While the belt 62 may be made of a composite of different materials, the belt 62 may be formed also from a number of discrete layers of material having different degrees of hardness or other characteristics. As illustrated in the embodiment of the connector 51 shown in FIG. 5, the belt 62 may include an inner layer 79*a*—made from a material that is of high durometer hardness and that, accordingly, resists stretching and is slipperier—and a outer layer 79*b*—made from a material that is of a lower durometer hardness and that tends to stretch upon application of mild force. The resultant softer, stretchier outer layer 79*b* allows the belt 62 to conform better to the shape of the housing 52 while the harder inner layer 79*a* provides a surface 78 having a lower coefficient of friction as the head surface 78 of each inner rib 75 contacts the surface 82*b* of the grooves 82*a* between teeth 82 of pulley 81 and the raceway surface 55*a*. A material having high lubricity such as TEFLON® may be included also as a layer separate and inward from the inner layer 79*a* in belt 62 or be included as an added component within the material from which the inner layer 79*a* is made. The same or similar high lubricity material can be added inward from the surface 55*a* or be included as an added component within the material from which the raceway surface 55*a* or the housing 52 in the area of contact with the inner surface 71 of the belt 62 is made, thereby reducing friction between belt 62 and surface 55*a*.

While this invention has been described in detail with particular reference to preferred embodiments thereof, it will be understood that variations and modifications can be effected within the spirit and scope of the invention as described above and as defined in the appended claims.

I claim:

1. An apparatus for securely connecting a plug to a socket apparatus of computer-related equipment, said apparatus comprising:

a housing in which the plug is fixed;

a plurality of male elements, each of said male elements including a forward end and a rearward end, said forward ends projecting outward from a forward wall of said housing and sized and shaped to be received within openings associated with the socket, said rearward ends mated to a plurality of pulleys;

a continuous belt wrapped around said housing, said belt including an outer surface and an inner surface, said outer surface positioned adjacent to a surface of a surrounding wall of said housing, said inner surface in engaging contact with said plurality of pulleys; and whereby application of manipulative force to said outer surface causes said belt and thereby said plurality of pulleys and said plurality of male elements mated to said pulleys to rotate in synchronized fashion, whereby said male elements are uniformly receivable within said openings.

2. The apparatus as defined in claim 1, wherein said inner surface of said belt includes ribs sized and shaped to be received between teeth of said pulleys.

3. The apparatus as defined in claim 1, wherein said belt is comprised of a composite of materials.

4. The apparatus as defined in claim 1, wherein said outer surface of said belt is textured.

5. The apparatus as defined in claim 1, wherein said pulleys include pulley openings sized and shaped to matingly receive rearward ends of said male elements.

6. The apparatus as defined in claim 5, wherein said pulleys include springs contacting said rearward ends of said male elements and by which said male elements can be partially retracted into said pulley openings.

7. The apparatus as defined in claim 1, wherein said belt is comprised of layers of material.

8. The apparatus as defined in claim 7, wherein said layers of material includes an inner layer of high durometer material.

9. The apparatus as defined in claim 8, wherein said layers of material includes an outer layer of low durometer material.

10. Connector for securing an interface plug to a socket of computer-related equipment, said connector comprising:

a housing for the plug, said housing including a plurality of male elements rotatably carried such that forward ends of said male elements project from a front side wall of said housing for reception in openings associated with the socket; and synchronized power transmission means including a belt and pulleys, said belt wrapped around said housing and having an outer surface adjacent to a surrounding wall of said housing, said belt having an inner surface engagingly contacting said pulleys, each of said pulleys matingly contacting each of said male elements, whereby manipulative force applied to said outer surface of said belt is transmitted to said each of said pulleys, and thereby to said each of said male elements to rotate said male elements in synchronized fashion so that said male elements are uniformly receivable in the openings associated with the socket.

11. The connector as defined in claim 10, wherein said inner surface of said belt includes ribs sized and shaped to be received between teeth of said pulleys.

12. The connector as defined in claim 10, wherein said belt is comprised of a composite of materials.

13. The connector as defined in claim 10, wherein said outer surface of said belt is textured.

14. The connector as defined in claim 10, wherein said pulleys include pulley openings sized and shaped to matingly contact rearward ends of said male elements.

15. The connector as defined in claim 14, wherein said pulleys include springs within said pulley openings and contacting said rearward ends of said male elements, whereby said male elements can be partially retracted into said openings.

16. The connector as defined in claim 10, wherein said belt is comprised of layers of material.

17. The connector as defined in claim 16, wherein said layers of material include an inner layer of high durometer material.

18. The connector as defined in claim 17, wherein said layers of material include an outer layer of low durometer material.

19. A device for securing connection between a plug and a socket, said device comprising:

a belt wrapped around a housing in which the plug is fixed, said belt in rotatable engagement with surfaces of pulleys within said housing, each of said pulleys matingly contacting male elements sized and shaped to be rotatably received within openings associated with the socket, whereby by the application of manipulative force to said belt said belt rotates said pulleys and thereby said male elements to effect secure connection between the plug and the socket.

20. The device as defined in claim 19, wherein said belt includes inner ribs sized and shaped to be rotatably engaged within teeth of said pulleys.

* * * * *